US008511119B2

(12) United States Patent
Mazzucchelli

(10) Patent No.: US 8,511,119 B2
(45) Date of Patent: Aug. 20, 2013

(54) ANTI-THEFT DEVICE

(75) Inventor: Corrado Mazzucchelli, Grumello Del Monte (IT)

(73) Assignee: Plasti-Max S.p.A., Grumello Del Monte (IL)

( * ) Notice: Subject to any disclaimer, the term of this patent is extended or adjusted under 35 U.S.C. 154(b) by 0 days.

(21) Appl. No.: 13/484,052

(22) Filed: May 30, 2012

(65) Prior Publication Data

US 2012/0304709 A1 Dec. 6, 2012

(30) Foreign Application Priority Data

Jun. 6, 2011 (EP) ..... 11168840

(51) Int. Cl.
*E05B 65/00* (2006.01)

(52) U.S. Cl.
USPC ..... 70/57.1; 70/14; 70/19; 70/58; 24/704.1; 340/568.1; 340/572.1

(58) Field of Classification Search
USPC ..... 70/14, 19, 57.1, 58; 24/704.1, 704.2; 340/568.1, 572.1, 572.8, 572.9
See application file for complete search history.

(56) References Cited

U.S. PATENT DOCUMENTS 5,119,652 A * 6/1992 Costa ..... 70/57.1
5,144,820 A * 9/1992 Holmgren ..... 70/57.1
6,279,358 B1 * 8/2001 Costa ..... 70/57.1
6,374,647 B1 * 4/2002 Holmgren ..... 70/57.1
6,612,139 B1 * 9/2003 Costa ..... 70/57.1
6,631,629 B1 * 10/2003 Fuss et al. ..... 70/57.1
6,754,939 B2 * 6/2004 Belden et al. ..... 24/704.1
6,848,285 B2 * 2/2005 Stroh ..... 70/57.1
7,556,232 B1 * 7/2009 Begg ..... 248/316.7
7,808,382 B2 * 10/2010 Bonato ..... 340/568.2
8,035,518 B2 * 10/2011 Kolton et al. ..... 340/572.1
8,089,359 B2 * 1/2012 Lopez et al. ..... 340/572.1
2009/0278691 A1 * 11/2009 Valade ..... 340/572.8
2010/0126238 A1 * 5/2010 Mazzucchelli ..... 70/58
2012/0174635 A1 * 7/2012 Pierobon ..... 70/276

* cited by examiner

*Primary Examiner* — Suzanne Barrett
(74) *Attorney, Agent, or Firm* — Novak Druce Connolly Bove + Quigg LLP

(57) ABSTRACT

An anti-theft device which is characterized in that it comprises a first shaped body having a first mounting portion for mounting said device on an object to be protected and a second detection portion for supporting/housing means of signalling/detection, said first mounting portion including a first mounting surface and a first cavity housing first locking means, said anti-theft device further comprising a second shaped body comprising a first locking portion positioned internally to said first cavity and a second mounting portion comprising a second mounting surface, said first locking portion comprising second locking means coupled to said first locking means, the actioning of said first locking means determining the sliding of said second shaped body within said first cavity and the movement of said second mounting surface toward said first mounting surface.

17 Claims, 4 Drawing Sheets

ANTI-THEFT DEVICE

CROSS REFERENCE TO RELATED APPLICATIONS

This application is claims priority to Application No. 11168840.4 filed in Europe on Jun. 6, 2012 under 35 U.S.C. §119; the entire contents of all are hereby incorporated by reference.

The present invention relates to an anti-theft device, also known as anti-shoplifting device, used to protect objects, in e.g. shops, supermarkets, warehouses and similar, and to avoid/discourage the actions of thieves. The anti-theft device of the present invention is particularly useful and suitable to protect glasses, but it can be used for basically all objects, such as, e.g., shoes or clothes.

Anti-theft devices are well known in the art and they usually consist of a body which is somehow fixed on the object to be protected and include a detection/signaling system capable of generating alarms when passed through check-points.

The basic requirements for an effective anti-theft device include the possibility of being easily applied and rapidly removed by authorized personnel, maintaining at the same time the practical impossibility of being removed by unauthorized personnel. For this purpose the mechanism for fixing them onto the object to be protected includes special designed actuating part that can be operated by corresponding special designed tools, e.g. special designed screw-heads actuated by special designed screwdrivers.

Alternatively, the mechanism for fixing an anti-theft device onto the object to be protected can include magnetically actuated locking mechanism in which the fixing mechanism of the device is unlocked by a magnet used by, e.g., a shop assistant when the object is sold. However, this solution requires more complicated and costly mechanisms and can be relatively circumvented by thefts using a magnet to unlock and remove the anti-shoplifting device from the protected object.

A further problem is due to the relatively bulky structure of the anti-theft devices, particularly when they house magnetic or electronic signaling/detection cards or circuits and when they are used to protect relatively small object, e.g. glasses or sunglasses, in which the aesthetic appearance is extremely important to determine the consumer choices.

As a matter of facts, in most cases, the anti-theft devices applied on glasses, normally on an arm of the glasses, are relatively bulky and they laterally project from the glasses, so as to change the visual impact of the glasses and make it difficult to appreciate their aesthetic appearance. In practice, in most cases, it is difficult to appreciate the design of the glasses since a relevant part thereof is substantially hidden by the anti-theft device applied thereto.

It is therefore an object of the present invention to provide an anti-theft device in which the above-mentioned drawbacks are avoided or at least reduced.

More in particular, it is an object of the present invention to provide an anti-theft device, particularly for glasses, having a reduced visual impact with respect to the conventional anti-theft devices.

As a further object, the present invention is aimed at providing an anti-theft device, particularly for glasses, which can be easily applied and rapidly removed by authorized personnel only.

A further object of the present invention is to provide an anti-theft device, particularly for glasses, in which the lateral projection from the arm of the glasses is reduced.

Another object of the present invention is to provide an anti-theft device, particularly for glasses, which does not hide relevant parts of the object to be protected.

Another object of the present invention is to provide an anti-theft device, particularly for glasses, having a reduced number of mechanical parts.

Another object of the present invention is to provide an anti-theft device, particularly for glasses, having improved functionality.

Still another object of the present invention is to provide an anti-theft device, particularly for glasses, with reduced manufacturing costs.

Thus, the present invention relates to an anti-theft device which is characterized in that it comprises a first shaped body having a first mounting portion for mounting said device on an object to be protected and a second detection portion for supporting/housing means of signalling/detection, said first mounting portion including a first mounting surface and a first cavity housing first locking means, said anti-theft device further comprising a second shaped body comprising a first locking portion positioned internally to said first cavity and a second mounting portion comprising a second mounting surface, said first locking portion comprising second locking means coupled to said first locking means, the actioning of said first locking means determining the sliding of said second shaped body within said first cavity and the movement of said second mounting surface toward said first mounting surface.

In this way, it is possible to overcome some of the disadvantages and drawbacks of the anti-theft devices of the known art.

In particular, the presence of the second shaped body partially sliding inside the first cavity when the anti-theft device is fixed onto the object to be protected allows to greatly reduce the visual impact of the anti-theft device when it is mounted onto, e.g. an arm of glasses. In other word, contrary to the conventional anti-theft device, the second mounting surface is drawn towards the first mounting surface thereby reducing the lateral projection of the anti-theft device when mounted onto the arm of glasses or onto other objects to be protected.

Also, in the anti-theft device of the invention, the second detection portion which supports/houses the means of signalling/detection can be very slim thereby further reducing the visual impact of the anti-theft device once mounted on the arm of glasses.

Moreover, the mounting/removal of the anti-theft device onto the object to be protected can be carried out in very simple manner by the authorized personnel by acting on the first locking means, e.g. screw means, that are conveniently shaped so as to be actuated only by specially designed tools, e.g. a screwdriver with a special head.

Another important advantage derives form the fact that, as better explained in the following description, the anti-theft device of the invention can be realized with a reduced number of pieces and with reduced mechanical complexity, thereby reducing the manufacturing costs.

According to a preferred embodiment of the anti-theft device of the invention, the second shaped body has a substantially parallelepipedic shape, with a first, second, third and fourth side that define an internal open space.

Preferably, the locking means comprises screw means positioned in a substantially fixed position in said first cavity and rotationally movable with respect to their longitudinal axis. In this way, when actuated, the screw means draw the second shaped body, and consequently the second mounting surface, toward the first shaped body and the first mounting surface, thereby reducing the overall dimensions of the devices and its visual impact. In such a case, preferably the second locking means comprises a threaded hole positioned on a first side of said second shaped body, said screw means being engaged in said threaded hole.

In a particular embodiment of the anti-theft device of the invention, the first cavity has a base that defines said first mounting surface. In said case, said screw means preferably rest on said base, and, for instance, they can be rotationally mounted on a pin on said base.

Advantageously, the second mounting surface can be positioned on said third side of said second shaped body facing on said internal open space.

In a particularly preferred embodiment of the anti-theft device of the invention the first shaped body comprises a first and a second half-shell coupled together, with said first and second half-shells preferably defining a second cavity for housing said means of signalling/detection.

In this case, the first half-shell can be substantially planar and can have raised edges mating corresponding edges on said a second half-shell, said first half-shell further having coupling means for coupling with said second half-shell. Then, the second half shell can have a first raised portion defining said first cavity and a second raised portion defining said second cavity.

In order to avoid damages to the object to be protected, in the anti-theft device of the invention, the first and second mounting surface (i.e. the surface entering into locking contact with the object) are preferably covered with a soft protection material, e.g. silicon rubber or any soft material capable of avoiding damages due to the locking action of the device onto the object.

Further characteristics and advantages of the invention will emerge from the description of preferred, but not exclusive embodiments of an anti-theft device according to the invention, non-limiting examples of which are provided in the attached drawings, wherein.

Figure 1:
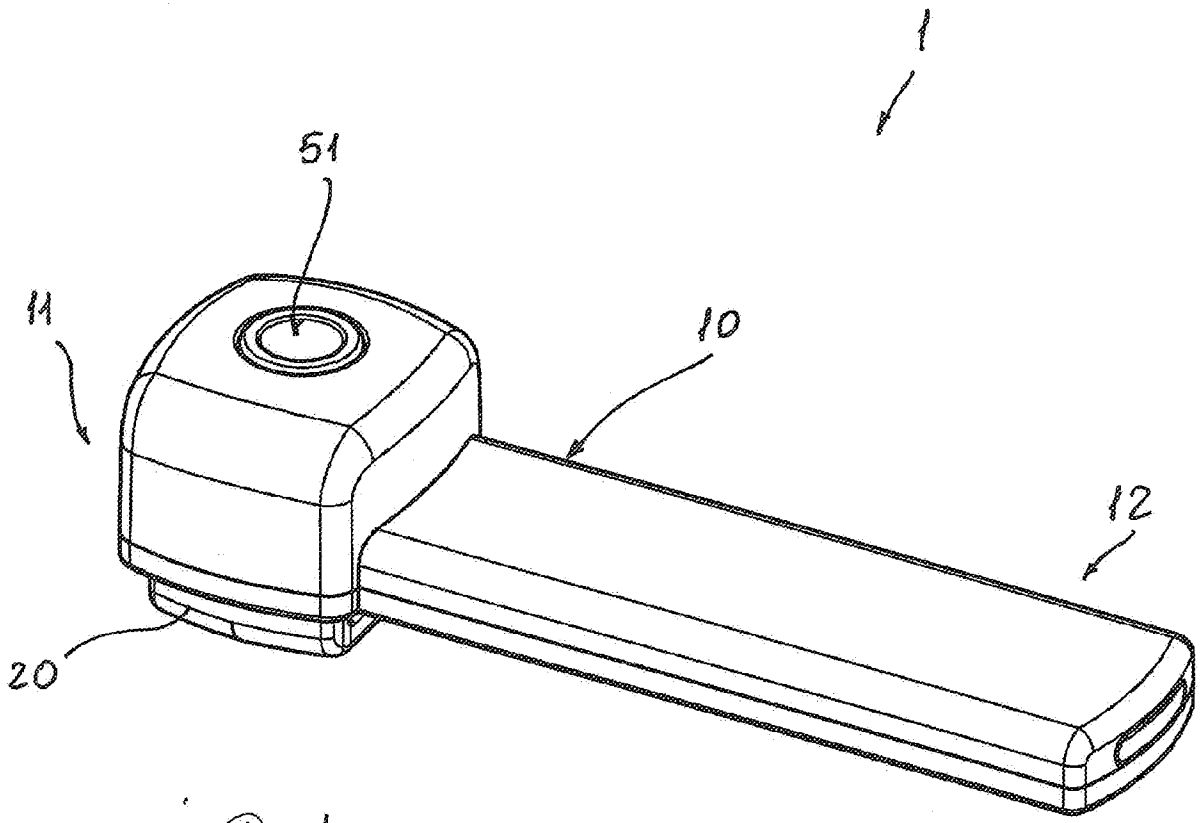
FIG. 1 is a perspective view of an embodiment of an anti-theft device according to the invention.

With reference to the attached figures, an anti-theft device according to the present invention, designed with the reference number 1, comprises, in its more general definition, a first shaped body 10 which has a first mounting portion 11 for mounting said device on an object to be protected, e.g. an arm of glasses.

The first shaped body 10 further comprises a second detection portion 12 for supporting/housing means of signalling/detection, which can be, for example, a bar code or a magnetic card applied onto the surface or housed into a cavity of the second portion 12 of the devices, so as to be readable by the alarm devices usually present in checkpoints of a shop. The means of signalling/detection can be of any type and are well know in the art; they will not be described in further details in the present document.

In the anti-theft device 1 according to the invention the said first mounting portion 11 includes a first mounting surface 31 and a first cavity 41 housing first locking means 51, whose functionality will be better described hereinafter.

The anti-theft 1 device further comprises a second shaped body 20 which in turn comprises a first locking portion 25 which is positioned internally to said first cavity 41 and a second mounting portion 26 which comprises a second mounting surface 32.

More in details, the first locking portion 25 of the second shaped body 20 comprises second locking means 52 which are coupled to said first locking means 51, so that by acting on said first locking means 51, the second shaped body 20 slides within said first cavity 41; at the same time the second mounting surface 32 moves toward the first mounting surface 31.

In other words, contrary to conventional systems in which the locking means usually push one of the mounting surfaces towards the other, in the anti-theft device of the present invention one of the mounting surfaces is drawn toward the other and toward the interior of the device, thereby reducing the overall volume and encumbrance of the device once mounted onto the object.

In order to achieve the above-described effect, the first locking means 51 preferably comprise, for example, screw means 510 which are positioned in a substantially fixed position in said first cavity 41 and rotationally movable with respect to their longitudinal axis.

In other words, the screw means 510 are positioned in the first cavity 41 so as not to shift with respect to it, but being free to rotate with respect to their longitudinal axis. In this way, since the screw means 510 are coupled to the second shaped body 20 through the second locking means 52, by rotating the screw means 510 they draw the second shaped body 20 inside the first cavity 41 and, consequently, the second mounting surface 32 toward the first mounting surface 31 until the first is in close contact with the latter. By putting a part of the object to be protected, e.g. an arm of glasses, in the space between the first 31 and the second 32 mounting surfaces, the anti-theft device becomes fixed on said object in a way that cannot be removed.

According to a preferred embodiment, the second shaped body 20 has a substantially parallelepipedic shape, with a first 21, second 22, third 23 and fourth 24 side that define an internal open space 29.

Figure 2:
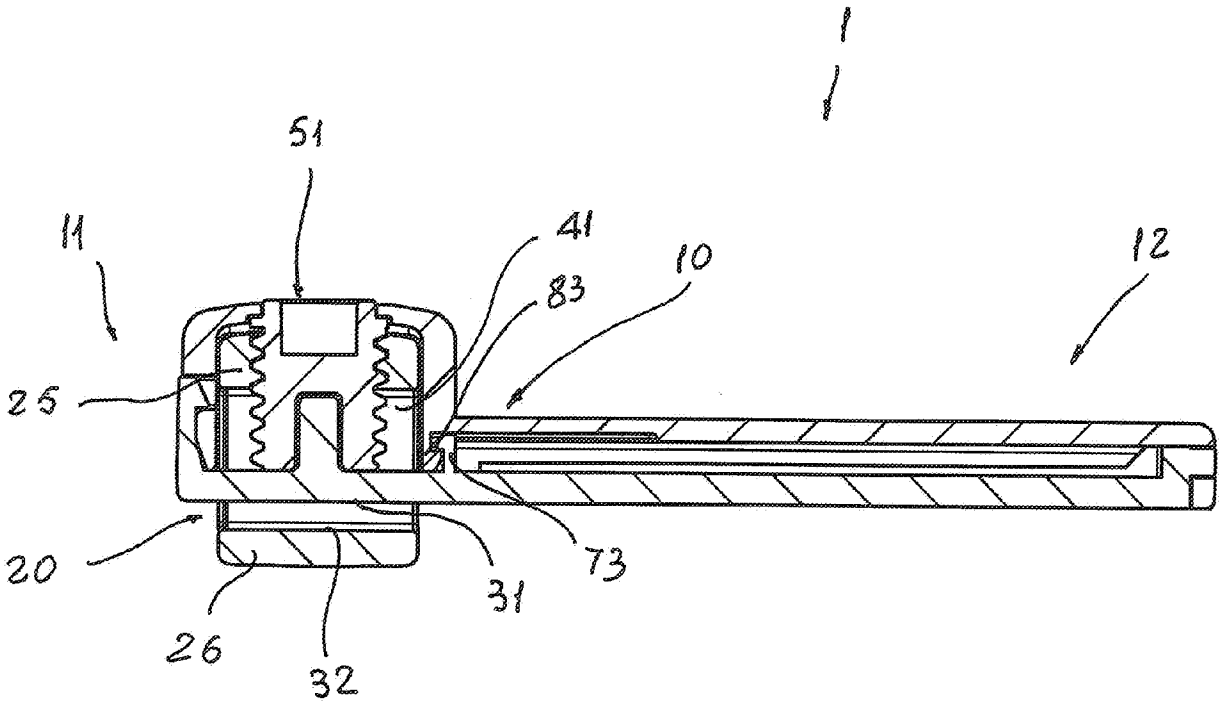
FIG. 2 is a section view of an embodiment of an anti-theft device according to the invention.

In this case, as shown in the attached figures, the second locking means 52 preferably comprise a threaded hole 520 which positioned on said first side 21 of the second shaped body 20, said screw means 510 being engaged in said threaded hole 520. In particular, as shown in FIG. 2, threaded hole 520 is positioned in the first locking portion 25 which in turn is positioned internally to said first cavity 41.

Preferably, the first cavity 41 has a base 410 that defines said first mounting surface 31. In such a case, the screw means 510 advantageously rest on said base 410 and can be, for instance, rotationally mounted on a pin 61 on said base 410.

When the second shaped body 20 has a substantially parallelepipedic shape as previously described, the second mounting surface 32 can be conveniently positioned on the third side 23 of said second shaped body 20 facing on said internal open space 29.

Figure 3:
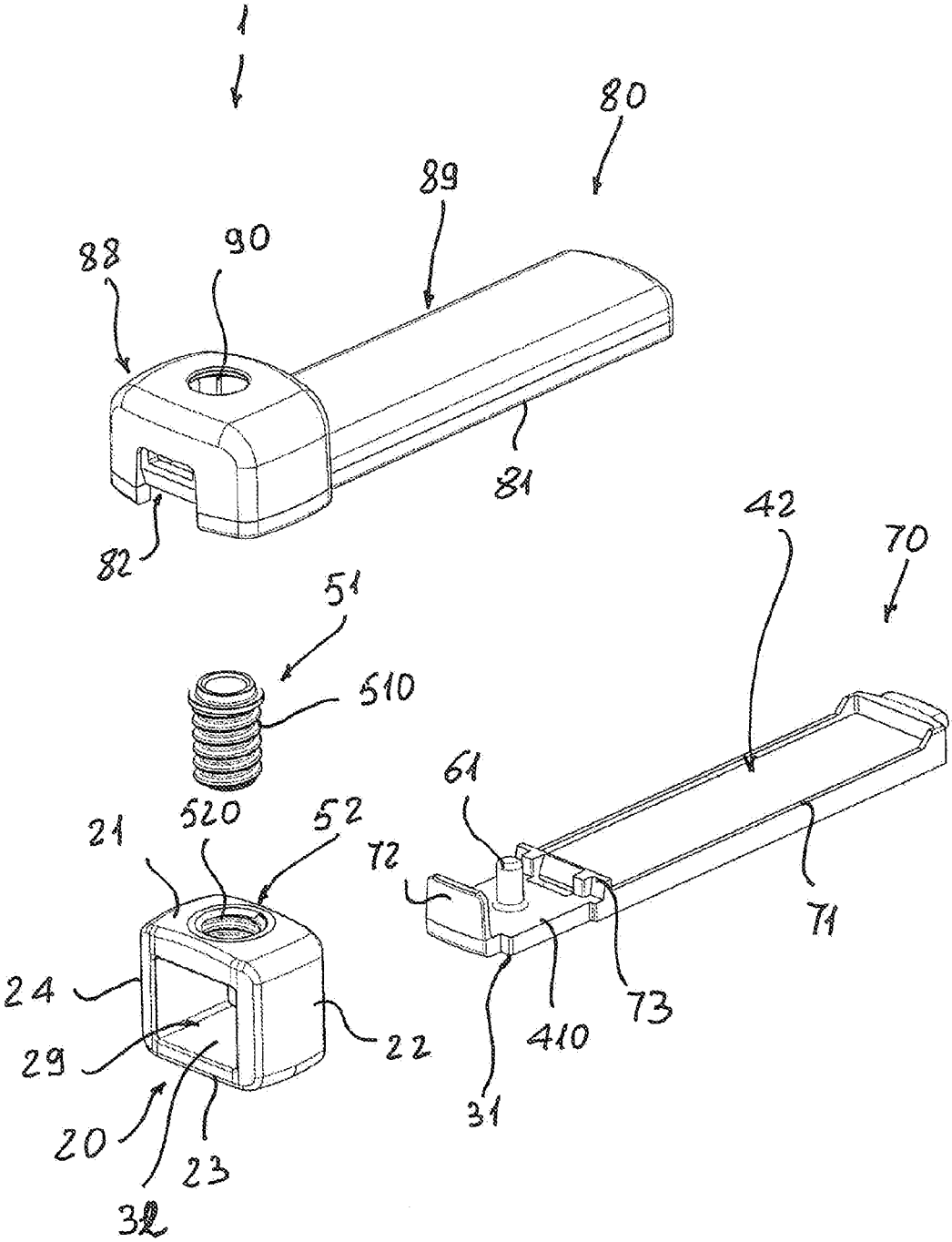
FIG. 3 is a first exploded view of an embodiment of an anti-theft device according to the invention.
Figure 4:
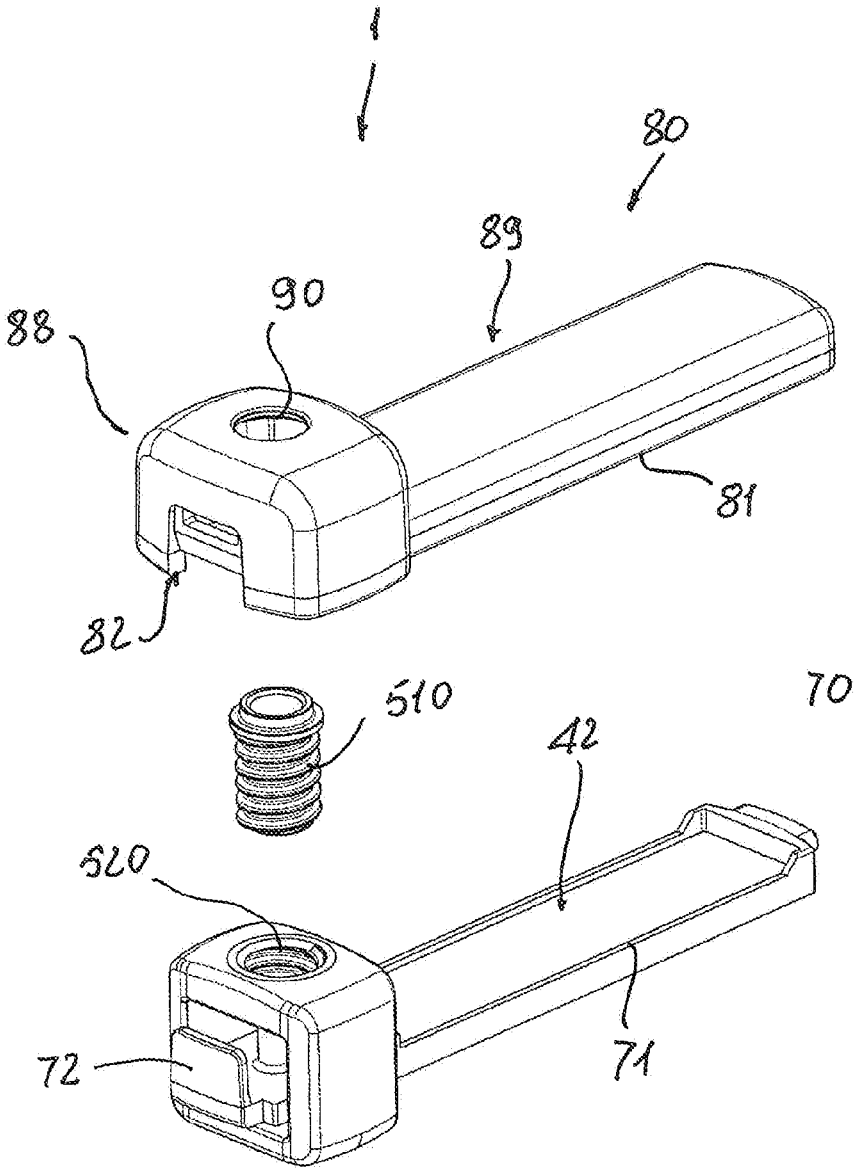
FIG. 4 is a second exploded view of the anti-theft device of FIG. 3.

A largely preferred embodiment of the anti-theft device 1 of the present invention is described in FIGS. 3 and 4. In said embodiment, the said first shaped body 10 comprises a first 70 and a second 80 half-shell which are coupled together.

In this way it can be possible, by appropriately shaping the first 70 and second 80 half-shells, to define, in addition to the first cavity 41, also a second cavity 42 for housing said means of signalling/detection.

In particular, the first half-shell 70 can be conveniently planar and can have raised edges 71 mating corresponding edges 81 on said second half-shell 80. Furthermore, the first half-shell 70 can have coupling means for coupling with said second half-shell 80.

As shown in FIGS. 3 and 4, the second half shell 80 preferably has a first raised portion 88 which defines the first cavity 41 and a second raised portion 89 which defines the second cavity 42. Moreover, a hole 90 is defined in said first raised portion 88 for accessing said first locking means 51, e.g. the head of the screw means 510.

Thus, with reference to FIGS. 3 and 4, an anti-theft device can be realized with only four pieces, namely: the first half-shell 70, the second half-shell 80, the second shaped body 20, and the screw means 510.

The first half-shell 70 has a portion that define the lower part of the second cavity 42 and a portion that defines the base 410 of the first cavity 41; on said base 410, a pin 61 for engaging the screw means 510 is conveniently positioned. The first mounting surface 31 is defined on said portion that defines the base 410, on the opposite side with respect to said base 410.

The second shaped body 20 has a substantially parallelepipedic shape, with a first 21, a second 22, a third 23 and a fourth 24 side that define an internal open space 29. On said first side 21, there are positioned the second locking means 52, in this embodiment being realized by the threaded hole 520. The surface of the third side 23 facing into the internal open space 29 constitutes the second mounting surface 32.

The second half shell 80 has a first raised portion 88 which defines the first cavity 41 and is positioned above the base 410 defined on the first half shell 70. Moreover the second half shell 80 has a second raised portion 89 which, together with the corresponding portion of the first half shell 70, defines the second cavity 42. A hole 90 is defined in the first raised portion 88 for accessing the head of the screw means 510.

The assembly of the anti-theft device 1 is very simple. Starting from the situation of FIG. 3, the first half shell 70 is inserted into the internal open space 29 of the second shaped body 20, so that the first mounting surface 31 is faced to the second mounting surface 32 (see FIG. 4). Then, the screw means 510 are screwed into the threaded hole 520 until they are engaged into the pin 61. Finally, the second half shell 80 is positioned on the first half shell 70 and fixed to it, so as to realize the final structure shown in FIG. 2, in which the first locking portion 25 of the second shaped body 20 is inglobated inside the first cavity 41.

By acting on the head of the screw means 510 and rotating them, the second shaped body is moved with respect to the assembly consisting of the first 70 and second 80 half shells, thereby moving the second mounting surface 32 away from/close to the first mounting surface 31. By inserting a piece of an object, e.g. an arm of glasses in the space between said first and second mounting surfaces 31, 32, the anti-theft device can be fixed/removed form said object.

By using a special designed head of the screw means 510, the removal of the anti-theft device can be carried out only by authorized personnel, with a corresponding special designed tool, e.g. special designed screwdriver.

Preferably the first half shell 70 has a first tooth 72 mating a cut-out section 82 in the peripheral walls of said first raised portion 88, and first interlocking means 73 snap-fitting with second interlocking means 83 of said second half shell 80. In this way, removal of the anti-theft device by separating the first half shell 70 from the second half shell 80 is not possible unless breaking the device 1 itself.

In order to protect the object from the effects of the pressure exerted by the first and second mounting surfaces, said first 31 and second 32 mounting surfaces are covered with a soft protection material, e.g. silicon or similar rubbers.

Thus, as explained above, the anti-theft device of the invention allows to achieve all the intended objects, overcoming the problems of the prior art devices.

In particular, the encumbrance of the device is limited, thereby limiting its visual impact. In particular, when the objects to be protected are glasses, the lateral projection from the arm is very limited, due to the fact that the second shaped body is drawn inside the first cavity, with the second mounting surface being drawn toward the first mounting surface.

It is also worth mentioning that the anti-theft device can be kept very slim, thereby further limiting its visual impact.

Moreover, the anti-theft device can be realized in a relatively simple manner, with reduced mechanical complexity and with a reduced number of pieces, in particular with only four pieces.

As explained above, the safety can be guaranteed by using suitable shaped locking means, e.g. suitable shaped heads of screw means, that cannot be operated with conventional tools.

The anti-theft device thus conceived may undergo numerous modifications and come in several variants, all coming within the scope of the inventive concept. Moreover, all the component parts described herein may be substituted by other, technically equivalent elements. In practice, the component materials and dimensions of the device may be of any nature, according to need and the state of the art.

The invention claimed is:

1. An anti-theft device wherein it comprises a first shaped body having a first mounting portion for mounting said device on an object to be protected and a second detection portion for supporting/housing means of signalling/detection, said first mounting portion including a first mounting surface and a first cavity housing first locking means, said anti-theft device further comprising a second shaped body comprising a first locking portion positioned internally to said first cavity and a second mounting portion comprising a second mounting surface, said first locking portion comprising second locking means coupled to said first locking means, the actioning of said first locking means determining the sliding of said second shaped body within said first cavity and the movement of said second mounting surface toward said first mounting surface, and wherein said first cavity has a base that defines said first mounting surface, said first locking means comprises screw means positioned in a substantially fixed position in said first cavity and rotationally moveable with respect to their longitudinal axis, and said screw means rests on said base.

2. The anti-theft device according to claim 1, wherein said second shaped body has a substantially parallelepipedic shape, with a first, second, third and fourth side that define an internal open space.

3. The anti-theft device according to claim 2, wherein said second locking means comprises a threaded hole positioned on said first side of said second shaped body, said screw means being engaged in said threaded hole.

4. The anti-theft device according to claim 1, wherein said screw means are rotationally mounted on a pin on said base.

5. The anti-theft device according to claim 2, wherein said second mounting surface is positioned on said third side of said second shaped body facing on said internal open space.

6. The anti-theft device according to claim 1, wherein said first shaped body comprises a first and a second half-shell coupled together.

7. The anti-theft device according to claim 6, wherein said first and second half-shells define a second cavity for housing said means of signalling/detection.

8. The anti-theft device according to claim 6, wherein said first half-shell is substantially planar and has raised edges mating corresponding edges on said second half-shell, said first half-shell further having coupling means for coupling with said second half-shell.

9. The anti-theft device according to claim 8, wherein said second half shell has a first raised portion defining said first cavity and a second raised portion defining said second cavity, a hole (90) being defined in said first raised portion for accessing said first locking means.

10. The anti-theft device according to claim 9, wherein said first half shell has a first tooth mating a cut-out section in the peripheral walls of said first raised portion, and first interlocking means snap-fitting with second interlocking means of said second half shell.

11. The anti-theft device according to claim 1, wherein said first and second mounting surfaces are covered with a soft protection material.

12. The anti-theft device according to claim 2, wherein said first locking means-comprises screw means positioned in a substantially fixed position in said first cavity and rotationally movable with respect to their longitudinal axis.

13. The anti-theft device-according to claim 1, wherein said second locking means comprises a threaded hole positioned on said first side of said second shaped body, said screw means being engaged in said threaded hole.

14. The anti-theft device according to claim 2, wherein said first cavity has a base that defines said first mounting surface.

15. The anti-theft device according to claim 1, wherein said first cavity has a base that defines said first mounting surface.

16. The anti-theft device according to claim 3, wherein said first cavity has a base that defines said first mounting surface.

17. The anti-theft device according to claim 1, wherein said second mounting surface is positioned on said third side of said second shaped body-facing on said internal open space.

* * * * *